US007407416B1

(12) United States Patent
Rogers et al.

(10) Patent No.: US 7,407,416 B1
(45) Date of Patent: Aug. 5, 2008

(54) MULTI-STAGE MULTI-POLE CONNECTOR

(75) Inventors: Frederick C. Rogers, Olathe, KS (US); Lyle T. Bertz, Lee's Summit, MO (US); Usman Muhammad Naim, Overland Park, KS (US)

(73) Assignee: Sprint Communications Company L.P., Overland Park, KS (US)

( * ) Notice: Subject to any disclaimer, the term of this patent is extended or adjusted under 35 U.S.C. 154(b) by 126 days.

(21) Appl. No.: 11/535,637

(22) Filed: Sep. 27, 2006

(51) Int. Cl.
*H01R 24/04* (2006.01)

(52) U.S. Cl. ..... 439/669

(58) Field of Classification Search ..... 439/669, 439/668

See application file for complete search history.

(56) References Cited

U.S. PATENT DOCUMENTS 2,702,376 A * 2/1955 Brush ..... 439/252
5,376,206 A * 12/1994 Maurer et al. ..... 156/242
6,425,783 B1 * 7/2002 Touboul ..... 439/638
6,461,199 B1 * 10/2002 Koga et al. ..... 439/668
6,524,138 B1 * 2/2003 Li et al. ..... 439/669
6,764,347 B1 * 7/2004 Plishner ..... 439/668
6,790,046 B2 * 9/2004 Haffenden et al. ..... 439/6
6,964,586 B2 * 11/2005 Siddiqui ..... 439/669
7,316,588 B1 * 1/2008 Rogers et al. ..... 439/668
2003/0207620 A1 * 11/2003 Haas et al. ..... 439/669

* cited by examiner

*Primary Examiner*—Gary F. Paumen

(57) ABSTRACT

A multi-stage, multi-pole connector provides improved connectivity with electronic devices having mating receptacles of differing form factors. In one aspect, the connector includes a hollow base plug portion, a hollow tip plug portion, and a series of conductive lines extending within the base plug portion and the tip plug portion. Both the base plug portion and the tip plug portion share the same longitudinal axis and are each formed with one or more discrete conductive contacts electrically isolated from one another. The tip plug portion extends axially from the base plug portion and has a smaller outside diameter along the length of the tip plug portion than the average outside diameter along the length of the base plug portion. This configuration causes the connector to step down in form factor to a smaller cross-sectional size moving from the base plug portion to the tip plug portion.

13 Claims, 5 Drawing Sheets

MULTI-STAGE MULTI-POLE CONNECTOR

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

Interconnectivity between electronic devices is commonly accomplished through a connector arrangement in non-wireless signal transmission situations. One type of conventional connector system employs a single or multi-prong conductive male element, or "plug" mating with a receptacle of an electronic device having corresponding conductive terminals. These connector systems are typically utilized to interconnect audio and/or video equipment, such as televisions, stereo equipment, DVD players, etc. Each conductive contact, or terminal, on the plug represents a dedicated channel for delivering a specific type of signal from a first device coupled with the plug through cabling to a second device having the receptacle. For instance, the channels may include audio left and right channels, as well as a ground. Individual pins of certain plug also can serve as channels to transmit a video signal as composite components, such as color and luminance, which are then delivered to the receptacle where circuitry of the device recombines the signals from the channels into a representative video signal. Other types of conventional connector systems utilize a plug and receptacle arrangement, but with recessed conductive terminals formed on the plug instead of projecting prongs. Examples of these types of connector systems include universal serial bus (USB) connectors and Firewire® connectors of Apple Computer, Inc., which are often utilized to interconnect components of a computing system (e.g., input/output devices with computer hardware) but also have found use in interfacing audio and/or video equipment with a computing system. Plug-type connectors have a series of conductive lines or cabling attached to the terminals within a body of the plug, with the cabling typically extending away from the plug inside of a cable sheath to the associated electronic device.

Depending on the particular application, conventional connector systems can have a number of drawbacks. As an example, the individual prongs or recessed terminals of plug-type connectors can be fragile and subject to breakage if the plug is not in proper rotational alignment with respect to the mating receptacle upon insertion. Additionally, the relatively small form factor of multi-prong connectors (as well as USB connectors and the like) typically results in the conductive terminals of the plug and/or receptacle having durability issues after numerous cycles of mating between the connector elements.

BRIEF SUMMARY

A single axis, multi-pole connector is provided for improved connectivity with electronic devices having mating receptacles of differing form factors. In one aspect, the connector includes a hollow base plug portion, a hollow tip plug portion, and a series of conductive lines extending within the base plug portion and the tip plug portion. Both the base plug portion and the tip plug portion share the same longitudinal axis and are each formed with one or more discrete conductive contacts electrically isolated from one another. The tip plug portion extends axially from the base plug portion and has a smaller outside diameter along the length of the tip plug portion than the average outside diameter along the length of the base plug portion. This configuration causes the connector to step down in form factor to a smaller cross-sectional size moving from the base plug portion to the tip plug portion. The conductive lines are electrically coupled with each conductive contact of the base plug portion and the tip plug portion for transporting discrete electrical signals to the respective conductive contacts. Thus, the differing form factors of the base plug portion and the tip plug portion provide an increased probability that a receptacle will have the same form factor as at least one of the base plug portion and the tip plug portion so that electrical signals can be transported from the connector to the receptacle and onto device circuitry coupled with the receptacle.

In another aspect, the base plug portion is formed as an insulative body. This configuration provides a form factor for mating of the base plug portion with a receptacle for a secure physical connection and reduced tendency of separation between the connector and the receptacle while the tip plug portion is of a form factor for facilitating an electrical coupling between conductive contacts of the tip plug portion and conductive terminals within the receptacle.

The multi-pole connector provides for a plurality of transmission channels through the conductive contacts. In one aspect, the channels may include audio left and right channels, a composite video channel, a microphone channel, an audio/video ground, and optionally, additional channels. In another aspect, the channels may form a data bus with discrete conductive pathways for the transmission of data, including a ground. Optionally, an electrical power channel may be present along with the data bus.

Additional advantages and features of the invention will be set forth in part in a description which follows, and in part will become apparent to those skilled in the art upon examination of the following, or may be learned by practice of the invention.

BRIEF DESCRIPTION OF THE SEVERAL VIEWS OF THE DRAWING

The present invention is described in detail below with reference to the attached drawing figures, wherein.

DETAILED DESCRIPTION

Certain embodiments of the present invention relate to a multi-pole connector system employing a multiple form factor unitary body connector design formed along a single longitudinal axis. This design increases the probability that the connector will have the same form factor as a corresponding electronic device receptacle for creating an electronic signal pathway between the conductive contacts of the connector and conductive terminals of the receptacle. In additional embodiments, the system employs a connector assembly including a single pin plug body and a mating sleeve adapted for seating on the plug body. By having configurable insulative and conductive contact regions for the plug body and sleeve, the connector assembly both increases the probability that the connector will have the same form factor as a corresponding electronic device receptacle, and also enables significant physical and electrical separation to be created between conductive contacts of the plug body and the conductive contacts of the sleeve. In further embodiments, a universal receptacle facilitates improved connectivity between electronic devices through plug-type connectors within a range of form factors.

Figure 1:
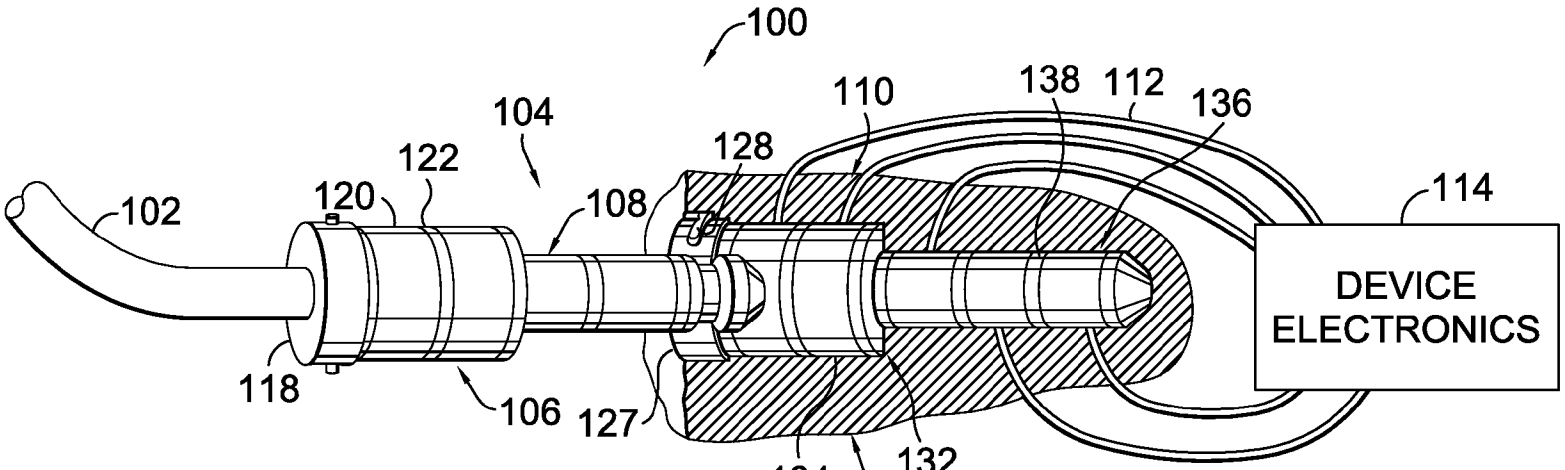
FIG. 1 is a schematic sectional side view of one embodiment of a connector system of the present invention illustrating a single axis, multi-pole connector moving into engagement with a multi-terminal receptacle of an electronic device.

Turning to FIG. 1, one embodiment of a connector system of the present invention is represented by reference numeral 100. The connector apparatus 100 includes conductive cabling 102, a multi-stage plug body 104 extending from the cabling 102 and formed of a base plug portion 106 and tip plug portion 108, a mating receptacle 110 for forming an electronic signal pathway with the plug body 104, conductive lines 112 electrically coupling with the receptacle 110 to relay signals therealong to circuitry 114 of an electronic device associated with the receptacle 110. For instance, the receptacle 110 may be formed into a housing 116 of the electronic device. The base plug portion 106 extends from a collar 118 of the plug body 104, and includes one or more conductive contacts 120 electrically isolated from one another. Preferably, when a series of conductive contacts 120 are present, the contacts 120 are interposed with one or more insulative rings 122 serving to electrically isolate adjacent contacts 120. The tip plug portion 108 extends axially from the base plug portion 104, and likewise includes one or more conductive contacts 120 electrically isolated from one another, the contacts 120 being interposed with one or more insulative rings 122 serving to electrically isolate adjacent contacts 120 when a series of contacts 120 are present. Thus, the base plug portion 106 and the tip plug portion 108 may have a similar conductive contact 120 configuration. It should be understood, however, that the particular number of conductive contacts on each of the base plug portion 106 and the tip plug portion 108 is a matter of design choice based on the number of dedicated transmission channels desired in transporting electrical signals through the plug body 104 to the receptacle 110, as will be explained in further detail below. The conductive contacts 120 may also be referred to herein as "terminals" or "poles".

Each conductive contact 120 of the base plug portion 106 and tip plug portion 108 of the series is associated with a transmission channel dedicated for transporting certain types of signals. Depending on how signals are transmitted by interconnected electronic devices, the channels may be either static or reconfigurable. With static channels, a single type of signal is always carried on a specific channel. For instance, a first conductive contact 120*a* may always deliver an "audio left" audio component to a corresponding receptacle 110 terminal. With reconfigurable channels, a specific channel may carry different types of signals which are dependant on the transmission schemes of the electronic devices interconnected by the connector system 100 (i.e., the electronic device associated or connected with the conductive cabling 102 opposite of the electronic device associated with the receptacle 110).

The receptacle 110 has an open end 127 and L-shaped slot 128 for receiving a locking protrusion 130 extending radially from the collar 118 of the plug body 104. As the plug body 104 is inserted into the receptacle 110, as shown in FIG. 1, the plug body 104 is rotationally aligned so that the locking pin 130 slides into the slot 128. The plug body 104 may then be rotated to move the locking pin 130 deeper into the slot 128, thereby inhibiting separation of the plug body 104 from the receptacle 110. The receptacle 110 has a first chamber section 132 including one or more conductive terminals 134 electrically isolated from one another and configured for mating with the conductive contacts 120 of the base plug portion 106, and a second chamber section 136 likewise including one or more conductive terminals 134 electrically isolated from one another and configured for mating with the conductive contacts 120 of the tip plug portion 108. As with the conductive contacts 120 on the plug body 104, the conductive terminals 134 may be interposed with insulative rings 138 serving to electrically isolate adjacent terminals 134. Thus, when the plug body 104 is inserted into the receptacle 110, the specific conductive contacts 120 of the plug body 104 that are aligned with and contacting the conductive terminals 134 of the receptacle 110 are capable of transmitting signals therebetween, thus forming the transmission channels extending along the conductive lines 112 to the circuitry 114 of the electronic device. Similar to the plug body 104, the particular number of conductive terminals 134 within the receptacle 110 is a matter of design choice based on the number of dedicated transmission channels desired in transporting electrical signals through the connector system 100.

As previously mentioned, the transmission channels may be reconfigurable. This comes into play, for example, when specific receptacle terminals 134 receive different signal types depending on either the particular arrangement of conductive contacts 120 on the mating plug body 104 or on the configuration of the electronic device transmitting signals to the plug body 104 for reception by the receptacle 110. To handle reconfigurable channels, the electronic device circuitry 114 may take the form of a universal Plug-and-Play (PnP) processor. The processor 114 "listens" for a predefined type of signal (e.g., audio left) on any of channels associated with the receptacle terminals 134. Upon detecting such a signal type, the processor 114 notes the particular terminal 134 position and its role (e.g., power, transmit, receive, etc.) based upon information in the received signals provided by an application run by the electronic device on the other end of the transmission system (i.e., on the other side of the plug body 104 from the receptacle 110). In this way, the processor 114 enables the electronic device associated with the receptacle 110 to properly handle signals that are received by the device from another electronic device while also transmitting signals requested by the other electronic device.

Figure 2:
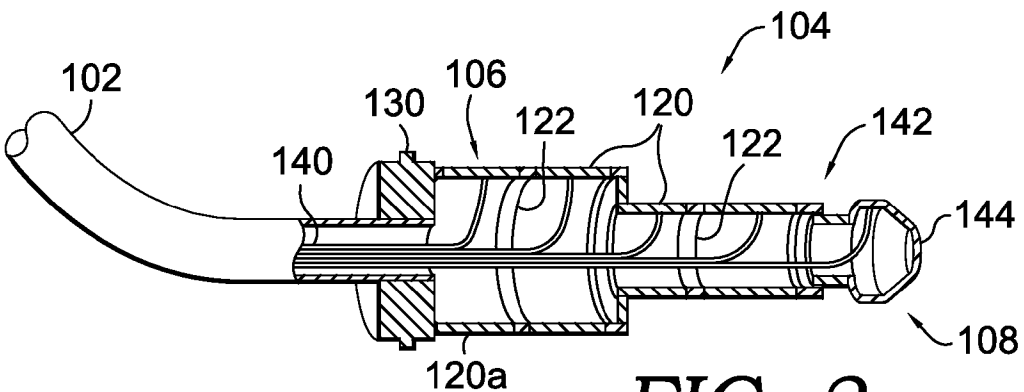
FIG. 2 is a sectional view of the single axis, multi-pole connector of FIG. 1 illustrating the connection of the conductive lines with corresponding conductive contacts of the base plug portion and the tip plug portion of the connector.

With reference to FIG. 2, a series of conductive lines or wires 140 extend within the cabling 102 and into the hollow base plug portion 106 and tip plug portion 108 to be electrically coupled with the conductive contacts 120 of the plug body 104. Specifically, each conductive line 140 handles a transmission channel for delivering signals to a respective one of the conductive contacts 120. The terminal ends of the conductive lines 140 may be soldered to the conductive contacts 120 of the plug body 104, or connected by other means as those of skill in the art appreciate. The cabling 102 housing the conductive lines 140 extends away from the plug body 104 to another connector or directly to an electronic device, as will be explained in further detail below with respect to FIG. 3.

The plug body 104, as can be seen in FIG. 2, provides the base plug portion 106 and tip plug portion 108 along a single, common axis, with the tip plug portion 108 providing a section of the plug body 104 with a step down in diameter or form factor from the base plug portion 106. As one practical example, the base plug portion 106 and the tip plug portion 108 may both be generally cylindrically shaped, with the base plug portion 106 having a diameter of 3.5 millimeters and the tip plug portion 108 having a diameter of 2.5 millimeter at least in a primary region 142 away from a terminal end 144 of the tip plug portion 108. Other form factors may be selected as those of skill in the art will appreciate. Preferably, both the base plug portion 106 and the primary region 142 of the tip plug portion 108 each have a constant diameter moving axially therealong for a more universal form factors in mating with receptacles 110 of a corresponding size. Additionally, it should be understood that the receptacle 110 is not limited to the form factors depicted in FIG. 1, where the receptacle 110 has the first chamber section 132 with a diameter for accepting the base plug portion 106 and the second chamber section 136 with a diameter for accepting tip plug portion 108. For instance, if the receptacle 110 only has single chamber section with a form factor compatible with the tip plug portion 108 of the plug body 104, then only the conductive contacts 120 of the tip plug portion 108 electrically couple with the conductive contacts 120 of the receptacle 110 when the plug body 104 mates with the receptacle 110. One example of such a configuration would be if the receptacle 110 were formed of only the second chamber section 136 extending inwardly from the receptacle open end 127. Likewise, if the receptacle 110 only has single chamber section with a form factor compatible with the base plug portion 106 of the plug body 104, then only the conductive contacts 120 of the base plug portion 106 (and possibly any contacts 120 at the terminal end 144 of the tip plug portion 108) electrically couple with the conductive contacts 120 of the receptacle 110 when the plug body 104 mates with the receptacle 110. One example of such a configuration would be if the receptacle 110 were formed of only the first chamber section 132 extending inwardly from the receptacle open end 127.

As mentioned above, and with reference to FIG. 3, the cabling 102 has a first end 146 where the plug body 104 is located and an opposed second end 148 that may have either another plug-type connector 150 or may connect directly with another electronic device 152. In this way, the cabling 102 carries the conductive lines 140 for electrical interfacing with circuitry of a device opposite of the device to which the plug body 104 is directly connected (i.e., through receptacle 110), allowing the interconnected devices to transmit and/or receive signals between each other. The plug-type connector 150 may have the same structure as the plug body 104, or alternatively, may have another type of connector structure with the same number of transmission channels as the plug body 104. For instance, the plug-type connector 150 may take the form of a USB plug connector or any other type of plug connector.

Embodiments of a connector assembly 200 of the present invention employing a pin and sleeve design are illustrated in FIGS. 4-9. One particular embodiment of the connector assembly 200, depicted in FIGS. 4-6, includes a single pin plug body 202 and sleeve 204 for sliding over the plug body 202, where conductive contacts regions of the plug body 202 and the sleeve 204 are configured for radial contact with one another. The plug body 202 is formed by a base collar 206 and a hollow, generally cylindrical pin member 208 extending axially from the collar 206. The sleeve 204 has generally cylindrical inner and outer surfaces 210 and 212. In this arrangement, the sleeve inner surface 210 friction fits over an outer surface 214 of the pin member 208 while the sleeve outer surface 212 mates with a receptacle of an electronic device (receptacle 110 of FIG. 1, as one example). Thus, the sleeve 204 and pin member 208 share a common axis. Each of the pin member 208 and the sleeve 204 include one or more conductive contacts 216, each conductive contact 216 being electrically isolated from any other conductive contact 216 on the respective one of the pin member 208 or the sleeve member 204. Preferably, when a series of conductive contacts 216 are present on the pin member 208 or the sleeve 204, the contacts 216 are interposed with one or more insulative rings 217 serving to electrically isolate adjacent contacts 216. Each conductive contact 216 of the pin member 208 (and thus of the plug body 202) and the sleeve 204 may be associated with a transmission channel dedicated for transporting certain types of electrical signals. In the case where a particular conductive contact 216 of the sleeve 204 radially interfaces with a particular conductive contact 216 of the plug body 202, electrical signals are carried between the particular conductive contacts 216 to form a shared transmission channel. The conductive contacts 216 may also be referred to herein as "terminals" or "poles".

Figure 5:
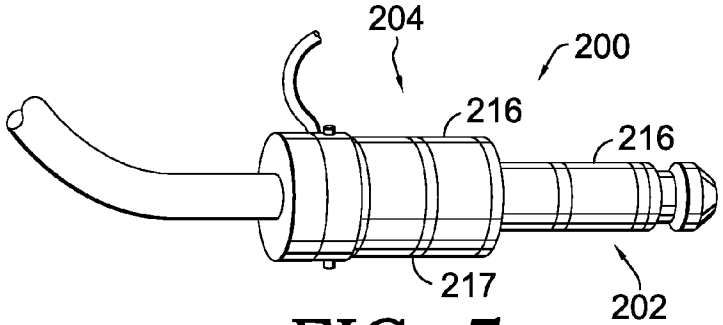
FIG. 5 is a schematic view of the connector assembly of FIG. 4 showing the sleeve seated on the plug body.

The pin member 208 is divided axially into a first region 218 and a second region 220. Each of the first and second region 218 and 220 contain one or more of the conductive contacts 216. The sleeve 204 is preferably configured to have an axial length that is less than the axial length of the pin member 208, ideally covering only the first region 218 when fully seated on the pin member 208, as shown in FIG. 5. This arrangement causes the conductive contacts 216 along the sleeve inner surface 210 to be radially aligned and in contact with the conductive contacts 216 of the first region 218 along the pin member outer surface 214. Thus, when the connector assembly 200 is inserted into a mating receptacle, such as receptacle 110 of FIG. 1, the signal pathway created across the interface of the conductive contacts 216 of the pin member first region 218 and the sleeve 204 may be used to carry electrical signals to the receptacle 110 that have reached the plug body 202 through cabling 222. At the same time, other electrical signals carried by the cabling 222 to the plug body 202 are transported across the signal pathway on the conductive contacts 216 of the pin member second region 220 to the receptacle 110. Of course, signals carried from the sleeve 204 or the pin member second region 220 to any interfacing conductive terminals of the receptacle (e.g., conductive terminals 134 of receptacle 110 of FIG. 1) require the receptacle to have a proper form factor for electrical coupling between the corresponding conductive contacts 216 and the respective receptacle conductive terminals to form an appropriate number of transmission channels for signals.

Figure 3:
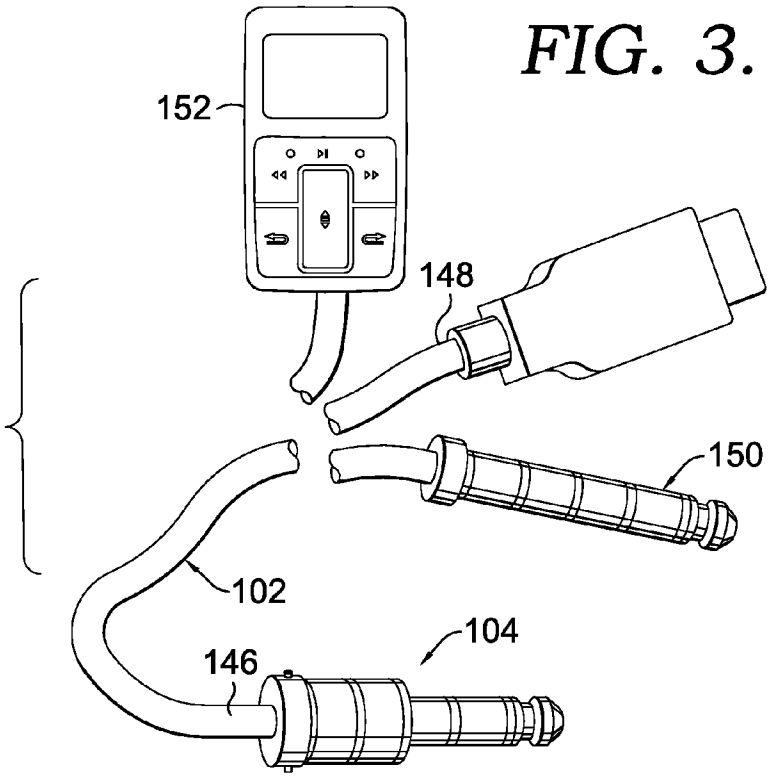
FIG. 3 is a schematic view of the single axis, multi-pole connector of FIG. 1 formed at one end of electrical cabling and an optional electrical connector coupled with the opposite end of the electrical cabling.
Figure 6:
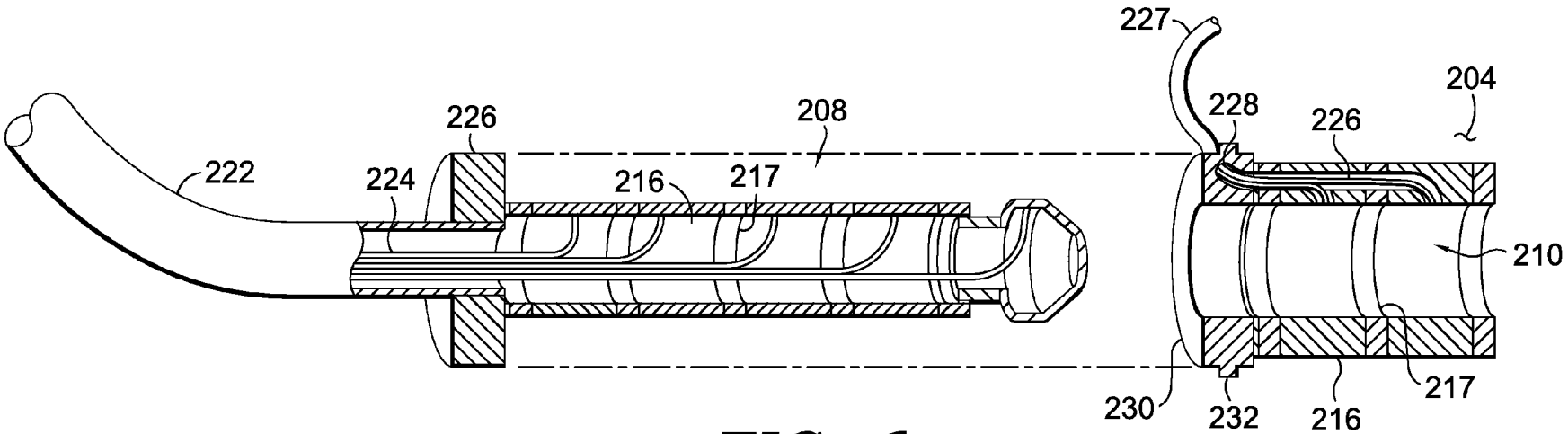
FIG. 6 is a schematic sectional view of the connector assembly of FIG. 4 illustrating the connection of the conductive lines with corresponding conductive contacts of the plug body and the sleeve.

With reference to FIG. 6, a first series of conductive lines or wires 224 extend within the cabling 222 and into the pin member 208 to be electrically coupled with the conductive contacts 216 of the plug body 202. Additionally, a second series of conductive lines 226 extend within additional cabling 227 into a cavity 228 of the sleeve 204 stretching from the perimeter of a base collar 230 of the sleeve 204 to the sleeve inner surface 210 at positions while enable terminal ends of the conductive lines 226 to electrically couple with the conductive contacts 216 of the sleeve 204. Each conductive line 224 of the first series and each conductive line 226 of the second series handles a transmission channel for delivering signals to a respective one of the conductive contacts 216 of the plug body 202 or a respective one of the conductive contacts 216 of the sleeve 204. The terminal ends of the conductive lines 224 and 226 may be soldered to the respective conductive contacts 216 of the plug body 202 and of the sleeve, or may be connected by other means as those of skill in the art appreciate. Similar to the connector system 100 of FIGS. 1-3, with the connector assembly 200 of the present embodiment, each cabling 222 and 227 housing the conductive lines 224 and 226, respectively, extends away from the plug body 202 and sleeve 204, respectively, to another connector or directly to an electronic device (e.g., as shown in FIG. 3). In one arrangement, cabling 222 and 227 extend to different electronic devices for carrying discrete signals from the devices to the connector assembly 200 for transporting across the signal pathways to the receptacle of an electronic device (e.g., receptacle 110). In a similar arrangement to the connector system 100 of FIGS. 1-3, the base collar 230 of the sleeve 204 has a locking protrusion 232 extending radially therefrom for aiding in maintaining the sleeve 204 within a receptacle having a mating slot.

Through the above described arrangement for the connector assembly 200, various signal transmission schemes are possible. For instance, in situations where the conductive contacts 216 of the sleeve 204 are radially aligned and in electrically conductive contact with contacts 216 of the pin member first region 218, such as when the sleeve 204 is fully seated on the pin member 208, electrical signals are preferably not transmitted simultaneously by particular conductive lines 224 that lead to contacts 216 in the pin member first region 218 and the conductive lines 226 leading to the contacts 216 of the sleeve 204, if such signals would interfere with one another. As one example, conductive line 224*a* would only carry signals simultaneously with conductive line 226*a* (signals which, upon reaching the radially aligned pin member 208 and sleeve 204, travel along the same transmission channel to the corresponding receptacle conductive terminal) if such signals can be handled by the circuitry of the electronic device housing the receptacle without interfering with one another. By implementing the connector assembly 200 design where both the sleeve 204 and the plug body 202 employ conductive contacts 216, different form factors are presented by a single connector assembly 200, thereby increasing the probability that an electronic device receptacle will have the same form factor as either or both of the sleeve 204 and the pin member section region 220 extending out from the sleeve 204. This design also allows for selection of a particular electronic device coupled with the plug body 202 or sleeve 204 to communicate with the electronic device of the receptacle (e.g., receptacle 110) through the particular receptacle terminals that interface with the contacts 216 of the sleeve 204 (e.g., terminals 134 of the first chamber section 132 of receptacle 110 of FIG. 1). In other words, the signals received by the contacts 216 of the sleeve 204 may ultimately originate from either the electronic device coupled to the sleeve 204 through cabling 227, or from the electronic device coupled to the pin member 208 through cabling 222 where the contacts 216 of the pin member first region 218 deliver the signals to the sleeve contacts 216. Thus, the sleeve 204 can essentially function in a passive role if desired, where the sleeve contacts 216 merely carry signals from the contacts 216 of the pin member first region 218 to a receptacle, where the receptacle presents a diameter that would otherwise be too large for mating with the pin member 208 (e.g., such as with first chamber section 132 of receptacle 110).

Figure 7:
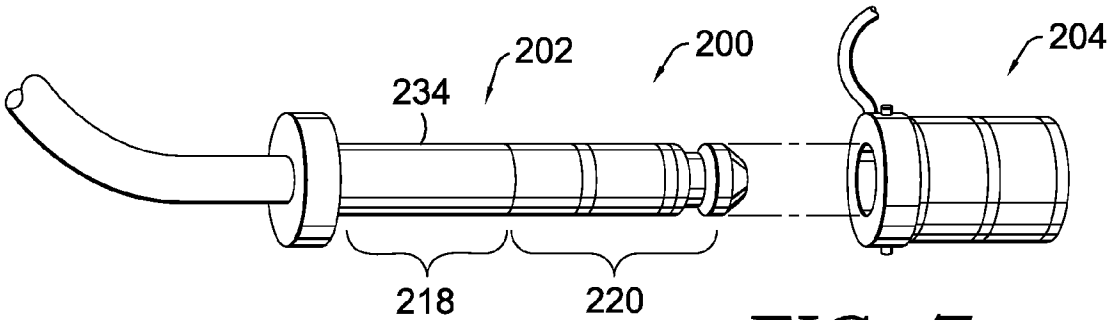
FIG. 7 is a schematic view of one embodiment of a connector assembly of the present invention illustrating a single pin, multi-pole plug body and an insulative sleeve moving into position over the plug body.

Another embodiment of the connector assembly 200 is depicted in FIG. 7. This embodiment provides a variation from the embodiment of the connector assembly depicted in FIGS. 4-6, where the conductive contacts 216 of the first region 218 of the plug body pin member 208 are replaced with an insulator 234. Thus, when the sleeve 204 is moved into a fully seated position on the pin member 208 over the first region 218 thereof, the contacts 216 of the sleeve 204 are aligned with the insulator 234. In this arrangement, no conductive pathway, and consequently, no shared transmission channel, is created between the contacts 216 of the sleeve 204 and the contacts of the pin member 208. This may be desired, for example, when additional physical separation and electrical separation is necessary between sleeve contacts 216 and pin member contacts 216 in order to reduce interference that may otherwise occur between electrical signals carried by the conductive lines 224 of the plug body 202 and the conductive lines 226 of the sleeve 204. For instance, if one of the plug body 202 or sleeve 204 has a dedicated transmission channel for delivering electrical power to the electronic device housing the receptacle (e.g., receptacle 110), it may be desirable to isolate that channel (and thus the corresponding contact 216) from other channels that are delivering data signals to the electronic device. One exemplary way of doing this is to have the one or more contacts 216 of the sleeve 204 only delivery electrical current for powering the electronic device of the receptacle, while the contacts of the second region 220 of the pin member 208 deliver data (e.g., audio data, video data, computer-related data) to the receptacle. When the sleeve 204 is fully seated on the insulator 234, the connector assembly 200 provides an outward appearance that is the same as that shown in FIG. 5.

Figure 4:
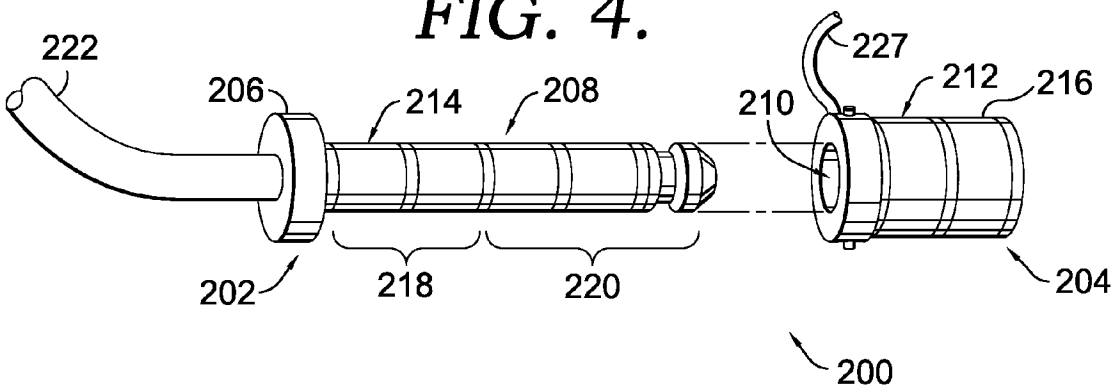
FIG. 4 is a schematic view of one embodiment of a connector assembly of the present invention illustrating a single pin, multi-pole plug body and a multi-pole sleeve moving into position over the plug body.
Figure 8:
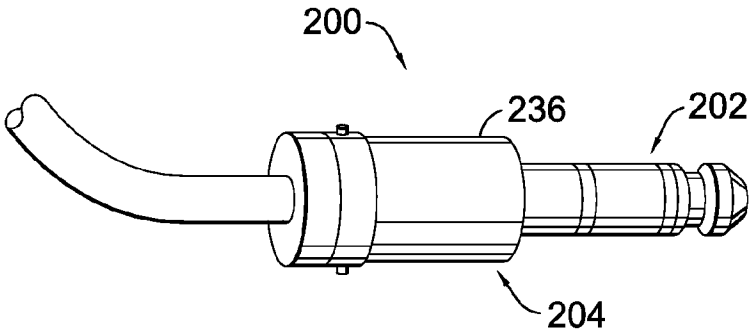
FIG. 8 is a schematic view of the connector assembly of FIG. 7 showing the sleeve seated on the plug body.
Figure 9:
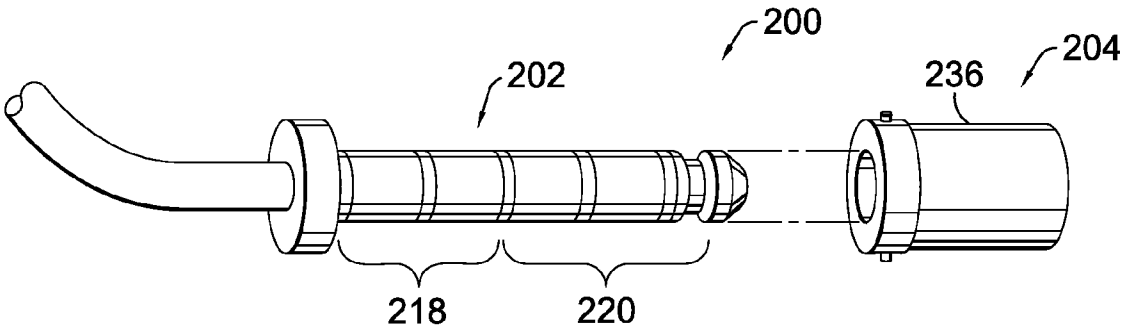
FIG. 9 is a schematic view of one embodiment of a connector assembly of the present invention illustrating a single pin, multi-pole plug body having an insulative region and a multi-pole sleeve moving into position for seating on the insulative region.

With reference to FIGS. 8 and 9, another connector assembly 200 embodiment is depicted, providing another variation from the embodiment of the connector assembly in FIGS. 4-6. Specifically, the connector assembly of FIGS. 8 and 9, the sleeve 204 is formed as an insulative body 236 without any conductive contacts 216 or conductive lines 226 extending therefrom. Thus, when the sleeve 204 is moved into a fully seated position on the pin member 208 over the first region 218 thereof, the insulative body 236 of the sleeve 204 covers any conductive contacts 216 of the pin member first region 218. This arrangement presents the conductive contacts 216 of the pin member first region 218 from forming conductive pathways with conductive contacts of a receptacle when the connector assembly 200 in the configuration shown in FIG. 8 mates with a corresponding electronic device receptacle. However, the sleeve 204 provides a form factor desirable for certain receptacle configurations (e.g., first chamber section 132 of receptacle 110) so that the connector assembly 200 firmly mates with the receptacle while positioning the contacts 216 of the pin member second region 220 in position to electrically couple with terminals of the receptacle (e.g., with conductive terminals 134 located in the second camber section 136 of receptacle 110).

The various embodiments of the connector assembly 200 of the present invention may also substitute for one or both of the plug body 104 and the plug-type connector 150 depicted in FIG. 3. Furthermore, as can be appreciated, the plug body 202 of the connector assembly 200 may be implemented without the sleeve 204 if desired to achieve a specific form factor or to otherwise mate with a receptacle and present the transmission channels desired. It should be understood that the transmission channels may be either static or dynamic depending on how signals are transmitted by electronic devices interconnected by the connector assembly 200.

Figure 10:
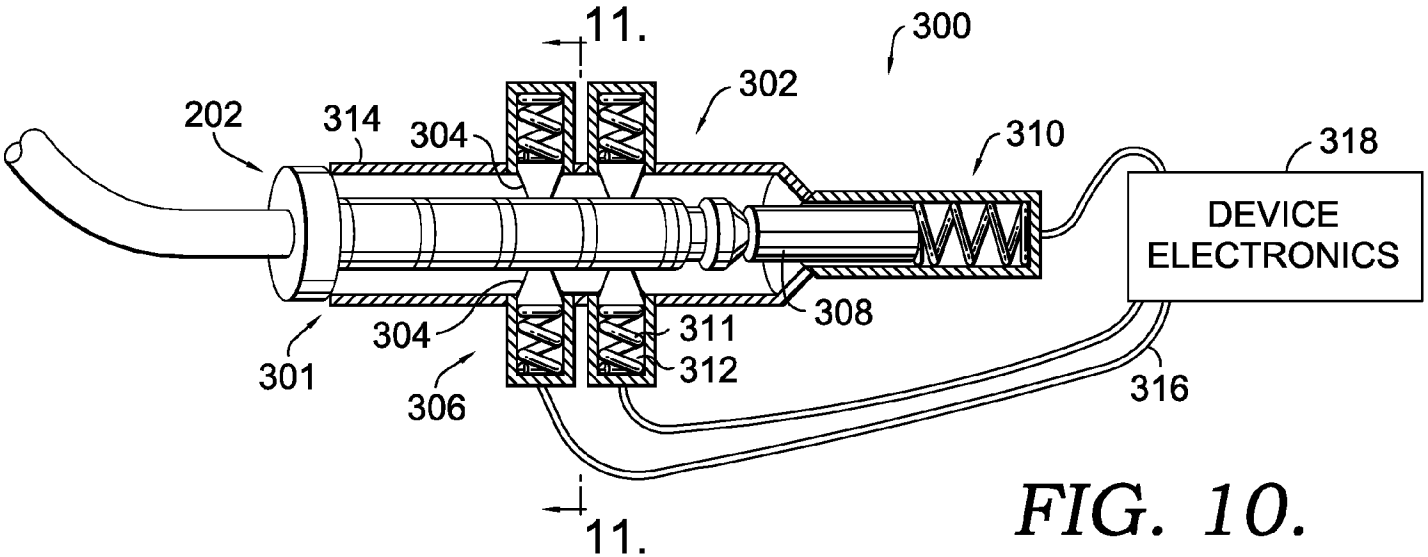
FIG. 10 is a schematic sectional side view of one embodiment of a connector system of the present invention illustrating a single axis, plug-type connector engaged with a multi-terminal, universal receptacle of an electronic device.
Figure 11:
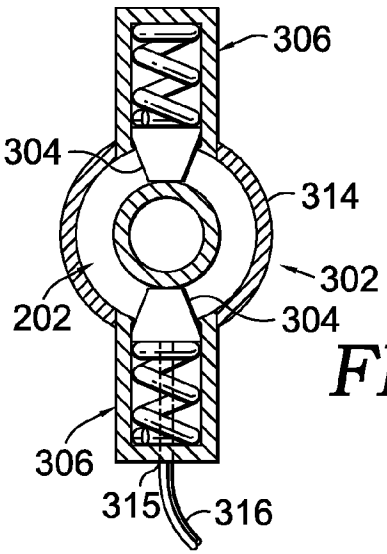
FIG. 11 is a schematic sectional end view of the plug-type connector and receptacle of FIG. 10.

One embodiment of a universal receptacle 300 is illustrated in FIGS. 10 and 11. The universal receptacle 300 facilitates improved connectivity between electronic devices through plug-type connectors within a range of form factors. For instance, the multi-stage plug body 104 of FIG. 1, as well as the connector assembly 200 of FIGS. 4-9 employing a combination plug body 202 and sleeve 204 design, may mate with the receptacle 300 assuming the cross-sectional dimensions of the designated plug-type connector are small enough to move into a first open end 301 of an elongate chamber 302 of the receptacle 300. The receptacle 300 may, for instance, be formed into a housing of an electronic device.

The receptacle 300 includes a first series of conductive terminals 304 that are biased inwardly towards a central region of the chamber 302 by urging structure 306. For instance, the urging structure 306 position the conductive terminals 304 for movement radially inwardly towards the chamber longitudinal axis when the chamber 302 is cylindrically shaped. A secondary conductive terminal 308 is located at a second end 310 of the chamber 302 opposite of the chamber first open end 301 and is biased outwardly and longitudinally within the chamber 302 towards the first open end 301 thereof by the urging structure 306. In the case where the chamber 302 is cylindrically shaped, the urging structure 306 positions the secondary terminal 308 for movement along the longitudinal axis of the chamber 302. The urging structure 306 is formed by a set of springs 311, such as compression springs, seated within recesses 312 formed in a perimeter wall 314 of the chamber 302. At the base of each recess 312, an aperture 317 is formed in the chamber perimeter wall 314 to enable conductive lines 316 to enter the chamber 302 and electrically couple with the respective terminals 304 (e.g., by soldering or other means). Both the chamber perimeter wall 314 and the springs 311 are preferably formed of non-electrically conductive materials, so that signals received across each signal pathway from the conductive contacts of the received plug-type connector (e.g., conductive contacts 216 of pin member 208 of FIGS. 4-9) to the interfacing receptacle terminals 304 are not exposed to unwanted interference. The conductive lines 316 relay signals received by the terminals 304 to circuitry 318 of an electronic device associated with the receptacle 300. Although only one terminal 304 electrically coupled with a respective conductive line 316 is required to contact a given conductive contact of the plug-type connector in order to deliver signals to the electronic device circuitry 318, if desired, each terminal 304 that contacts a given connector contact (e.g., contact 216 of pin member 208) may be electrically coupled with a conductive line 316 in order to increase the surface area of contact for signal travel across the conductive pathway from the connector contact to the respective terminal 304. The increased contact surface area increases the bandwidth available along a given channel for transmitting data. In the particular embodiment of the receptacle 300 depicted in FIG. 11, only one terminal 304 of a set of opposed terminals 304 contacting a given contact of a plug-type connector 202 is coupled to the conductive line 316 representing a specific transmission channel. The other terminal 304 not coupled to the conductive line 316 serves as a guide to urge the connector 202 towards the opposed terminal 304, both terminals 304 working together to center the connector 202 along the longitudinal axis of the chamber 302. The cross-sectional form factors supported by the receptacle 300 range from, on the large end, plug-type connectors having cross-sectional dimensions, or a diameter, just smaller than the cross-sectional dimensions or diameter of the chamber 302, to, on the small end, plug-type connectors having sufficient cross-sectional dimensions (diameter) as to maintain contact with the opposed terminals 304 that have been moved radially inwardly towards the center of the chamber 302 to the fullest extent possible by the urging structure 306. Additionally, the secondary conductive terminal 308 ensures that a range of connector lengths are also supported by the receptacle 300 when a terminal end of the connector has a conductive contact for carrying signals.

Because transmission channels may be reconfigurable, as explained above with reference to connector system 100 of FIGS. 1-3 (and equally applicable to connector assembly 200 or plug body 104 interfacing with receptacle 300), the electronic device circuitry 318 may take the form of a universal Plug-and-Play (PnP) processor. The processor 318 "listens" for a predefined type of signal on any of channels associated with the receptacle terminals 304, and upon detecting such a signal type, notes the particular terminal 304 position and its role (e.g., power, transmit, receive, etc.) based upon information in the received signals provided by an application run by the electronic device on the other end of the transmission system (i.e., on the other side of the plug-type connector from the receptacle 300, such as device 152 of FIG. 3).

The multi-pole configuration of the connector system 100 of FIGS. 1-3, and the connector apparatus 200 of FIGS. 4-9, facilitates a single connector body or modular apparatus having numerous poles for corresponding transmission channels. In one embodiment, at least five conductive contacts or terminals are present on the plug body 104 and receptacle 110 of the connector system 100, as well as on the combination of the plug body 202 and sleeve 204 of the connector apparatus 200, and the receptacle 300. In one embodiment, the transmission channels associated with the conductive contacts/terminals include at least an audio left channel, an audio right channel, a video channel, a microphone channel, and an audio/video ground. In another embodiment, the transmission channels form a data bus with an integer multiple of four or eight discrete conductive pathways for the transmission of data, as well as a ground. With such a data bus, each channel may transmit at a different line rate, similar to a universal serial bus or other similar connection scheme. Optionally, an electrical power channel may be present along with the data bus.

Overall, the larger form factor provided by the base plug portion 106 of the multi-stage plug body 104 and the sleeve 204 of the connector assembly 200 results in a larger surface area for increased bandwidth and thereby larger data transmission capabilities for a given transmission channel, as well as the ability for increased electrical current delivery to the receptacle 110 or 300 across a given signal pathway.

The aforementioned system has been described in relation to particular embodiments, which are intended in all respects to be illustrative rather than restrictive. Since certain changes may be made in the aforementioned system without departing from the scope hereof, it is intended that all matter contained in the above description or shown in the accompanying drawings be interpreted as illustrative and not in a limiting sense.

What is claimed is:

1. A single axis, multi-pole connector configured for delivering discrete electrical signals to a receptacle of an electronic device, comprising:

a hollow base plug portion formed with at least one discrete conductive contact;

a hollow tip plug portion formed with at least one discrete conductive contact and electrically isolated from the conductive contact of the base plug portion, wherein the tip plug portion extends axially from the base plug portion and has a smaller outside diameter along the entire axial length of the tip plug portion than the average outside diameter along the axial length of the base plug portion; and a series of conductive lines extending within the base plug portion and the tip plug portion and electrically coupled with each conductive contact of the base plug portion and each conductive contact of the tip plug portion for transporting discrete electrical signals to the conductive contacts of the base plug portion and the tip plug portion.

2. The connector of claim 1, wherein the at least one discrete conductive contact of the base plug portion comprises a series of conductive contacts, the base plug portion being further formed with at least one insulative ring, each insulative ring interposing adjacent conductive contacts of the base plug portion; and wherein the at least one discrete conductive contact of the tip plug portion comprises a series of conductive contacts, the tip plug portion being further formed with at least one insulative ring, each insulative ring interposing adjacent conductive contacts of the tip plug portion.

3. The connector of claim 1, further comprising a radially extending locking pin configured for engagement with a mating slot of the electronic device receptacle.

4. The connector of claim 1, wherein the base plug portion and the tip plug portion each have cylindrically shaped regions.

5. A method of electrically interfacing a connector with an electronic device, comprising:

providing a single axis multi-pole connector including:

a hollow base plug portion formed of a series of discrete conductive contacts electrically isolated from one another; and a hollow tip plug portion formed of a series of discrete conductive contacts electrically isolated from one another, wherein the tip plug portion extends axially from the base plug portion and has a smaller outside diameter along the entire axial length of the tip plug portion than the average outside diameter along the axial length of the base plug portion;

providing a receptacle with a series of conductive terminals, the receptacle having a first chamber section with a diameter at least as large as the largest outside diameter at any location along the axial length of the tip plug portion;

providing an electronic device with a series of conductive lines electrically coupled with the conductive terminals of the receptacle; and releasably securing the connector with the receptacle such that the conductive contacts of at least one of the base plug portion and the tip plug portion of the connector electrically couple with the conductive terminals of the receptacle to form an electronic signal pathway from the connector to the electronic device.

6. The method of claim 5, wherein the receptacle has a second chamber section with a diameter at least as large as the outside diameter of at least a first region of the base plug portion, the series of conductive terminals of the receptacle being located on the first chamber section and the second chamber section of the receptacle such that upon releasably securing the connector with the receptacle, the conductive contacts of the base plug portion and the conductive contacts of the tip plug portion, as a group, electrically couple with the conductive terminals of the first chamber section and the second chamber section of the receptacle.

7. A method of conveying electronic signals through a connector to an electronic device, comprising:

providing a single axis multi-pole connector including:

a hollow base plug portion formed of a series of discrete conductive contacts electrically isolated from one another; and a hollow tip plug portion formed of a series of discrete conductive contacts electrically isolated from one another, wherein the tip plug portion extends axially from the base plug portion and has a smaller outside diameter along the entire axial length of the tip plug portion than the average outside diameter along the axial length of the base plug portion;

providing a receptacle with a series of conductive terminals, the receptacle having a first chamber section with a diameter at least as large as the largest outside diameter at any location along the axial length of the tip plug portion;

providing an electronic device with a series of conductive lines electrically coupled with the conductive terminals of the receptacle;

releasably securing the connector with the receptacle such that the conductive contacts of at least one of the base plug portion and the tip plug portion of the connector electrically couple with the conductive terminals of the receptacle to form a signal pathway; and transporting electronic signals across the signal pathway, wherein the electronic signals are formed as a series of dedicated channels, each channel associated with one conductive contact of one of the series of conductive contacts of the base plug portion or the series of contacts of the tip plug portion.

8. The method of claim 7, wherein the series of channels comprise at least:

an audio left channel;

an audio right channel;

a video channel;

a microphone channel; and an audio/video ground.

9. The method of claim 7, wherein the series of channels comprise at least:

a data bus; and a ground.

10. The method of claim 9, wherein the series of channels further comprise an electrical power channel.

11. A single axis, multi-pole connector configured for delivering a plurality of discrete electrical signals to a receptacle of an electronic device, comprising:

a hollow base plug portion formed as an insulative body;

a hollow tip plug portion formed of a series of discrete conductive contacts electrically isolated from one another, wherein the tip plug portion extends axially from the base plug portion and has a smaller outside diameter along the entire axial length of the tip plug portion than the average outside diameter along the axial length of the base plug portion; and a series of conductive lines extending within the base plug portion and the tip plug portion and electrically coupled with each conductive contact of the tip plug portion for transporting discrete electrical signals to the conductive contacts of the tip plug portion.

12. The connector of claim 11, further comprising a radially extending locking pin configured for engagement with a mating slot of the electronic device receptacle.

13. The connector of claim 11, wherein the base plug portion and the tip plug portion each have cylindrically shaped regions.

* * * * *